US009626842B1

(12) United States Patent
Navon

(10) Patent No.: US 9,626,842 B1
(45) Date of Patent: Apr. 18, 2017

(54) ACCESSORIZED DOORBELL DEVICE

(71) Applicant: Guy Navon, Van Nuys, CA (US)

(72) Inventor: Guy Navon, Van Nuys, CA (US)

( * ) Notice: Subject to any disclaimer, the term of this patent is extended or adjusted under 35 U.S.C. 154(b) by 73 days.

(21) Appl. No.: 14/685,356

(22) Filed: Apr. 13, 2015

(51) Int. Cl.
*G08B 25/00* (2006.01)
*G08B 3/10* (2006.01)

(52) U.S. Cl.
CPC ..... *G08B 3/10* (2013.01)

(58) Field of Classification Search
USPC ... 340/384.1, 328, 384.5, 287, 392.1, 392.5, 340/393.3
See application file for complete search history.

(56) References Cited

U.S. PATENT DOCUMENTS

| | | | | |
|---|---|---|---|---|
| 7,079,014 | B2 | 7/2006 | Steinetz et al. | |
| 7,382,233 | B2 * | 6/2008 | Steinetz | G08B 3/10 340/384.1 |
| 7,570,154 | B2 * | 8/2009 | Bartorelli | G08B 3/10 340/328 |
| 2015/0109111 | A1 * | 4/2015 | Lee | G08B 3/1016 340/328 |

* cited by examiner

*Primary Examiner* — Qutbuddin Ghulamali
(74) *Attorney, Agent, or Firm* — Stevenson IP, LLC

(57) ABSTRACT

The accessorized doorbell device has a device control in wireless communication with an actuator, such as a doorbell. Chosen music and other informational playback upon an actuator's enablement plays from a plethora of music and other choices stored within and available to the device. A plurality of wireless playback units is provided such that chosen playback is selectively heard throughout or in an isolated area in an abode. A plurality of control buttons, a monitor, and a speaker provide discriminating input from the device control.

4 Claims, 3 Drawing Sheets

ACCESSORIZED DOORBELL DEVICE

BACKGROUND OF THE INVENTION

Of the various types of music capable doorbell devices known in the prior art none offer all advantages sought by users. For example, a chosen music and other informational playback, upon a doorbell actuation, from a plethora of music and other choices stored within and available to the device are needed. Completely wireless apparatus that perform this function are needed, as are internally powered control units and doorbell actuators. Multiple remote playback devices are also needed, and not just one playback device that is very difficult to locate centrally and still play sounds that are heard throughout an abode. In collusion, methods to choose which playback devices are employed with discriminating input are highly desirable features. Further needs include input from various sources with a monitor and speaker by which the user may visually and audibly monitor choices. The present device provides for these needs.

FIELD OF THE INVENTION

The present accessorized doorbell device relates to doorbells.

SUMMARY OF THE INVENTION

The general purpose of the accessorized doorbell device, described subsequently in greater detail, is to provide an accessorized doorbell device that has many novel features that result in an accessorized doorbell device which is not anticipated, rendered obvious, suggested, or even implied by prior art, either alone or in combination thereof.

To accomplish this, the accessorized doorbell device comprises the accessorized doorbell device has a device control having a front side and a back side spaced apart from the front side. The control device has at least one mount disposed on the back side. A plurality of control buttons is disposed in the front side. A monitor is disposed in the front side. The monitor provides visual feedback for a user of a plurality of control button choices. The choices include but are not limited to sources of a plurality of inputs and outputs of the device. The device control also internally has a USB port, a Bluetooth® capability, a WiFi® capability, an internal power source, an external power source connection in operational communication with the internal power source. The device control further has a speaker. A central processing unit (CPU) is disposed within the device control and contains the Bluetooth® capability and the WiFi® capability. The CPU is in operational communication with the control buttons, the monitor, the speaker, the USB port, the internal power source, and the external power source connection.

At least one wireless actuator is in operational communication with the device control. At least one playback unit is in wireless communication with the device control.

The control buttons are configured to provide for the user to choose from a myriad of choices. A plurality of individual controls is disposed within the CPU and comprise playback unit control, a duration control, and a sound control. The playback unit control is configured to regulate the playback units played. The duration control is configured to regulate a duration of the playback units played. The sound control is configured to regulate a sound emitted from the playback unit. For example, only a pair of playback units might be for use if the actuator is enabled for a continuous 5 seconds. Conversely, the actuator, such as a doorbell, typically sees a one-half second to one second enablement. The speaker only could be set to play upon such a signal. Also, every playback unit could be set to play upon the signal. A known visitor may be instructed to employ the signal for an identification by those within a given abode. The sound control may be set for the emission of a particular sound from the chosen playback units. The duration control not only determines a duration needed by the actuator to determine the sound emitted by the playback units.

Thus has been broadly outlined the more important features of the present accessorized doorbell device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
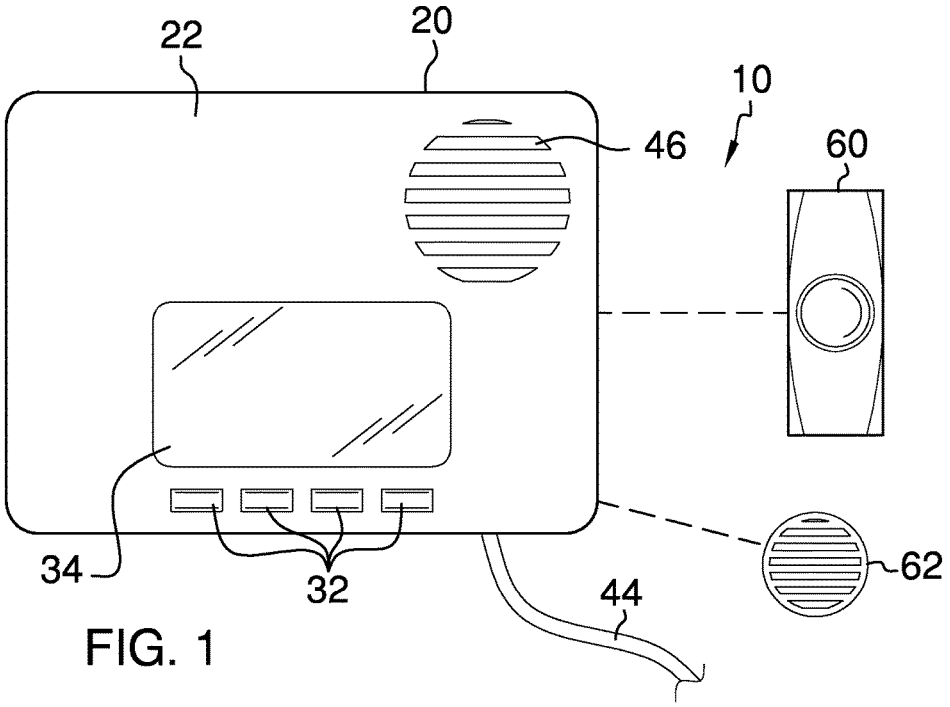
FIG. 1 is a front side elevation view of an accessorized doorbell device.
Figure 2:
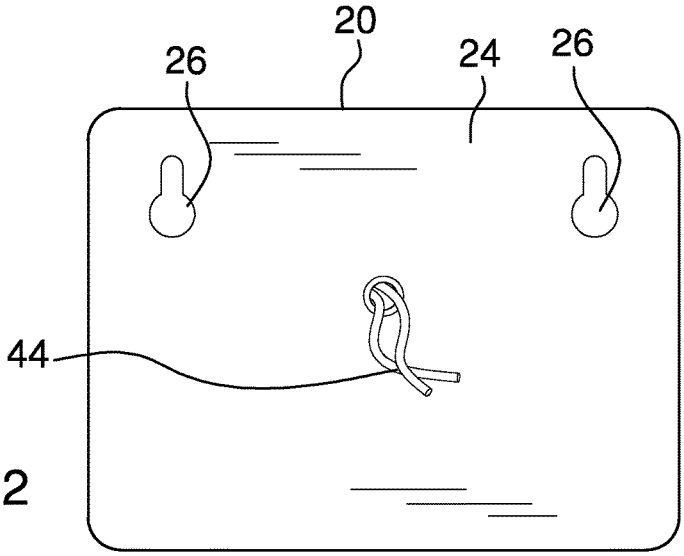
FIG. 2 is a back side elevation view of the accessorized doorbell device.
Figure 3:
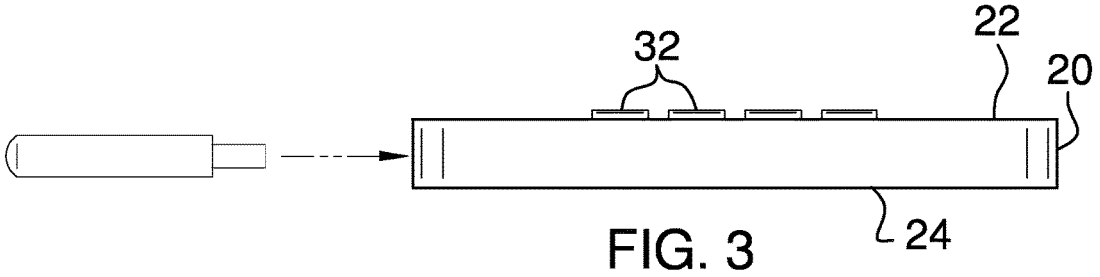
FIG. 3 is a lateral elevation view of a device control.
Figure 4:
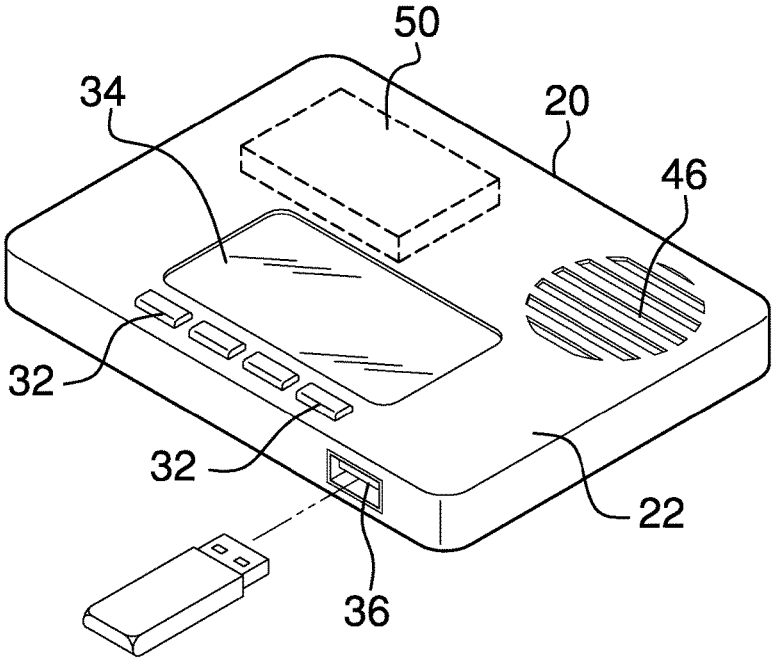
FIG. 4 is a perspective view of the device control.
Figure 5:
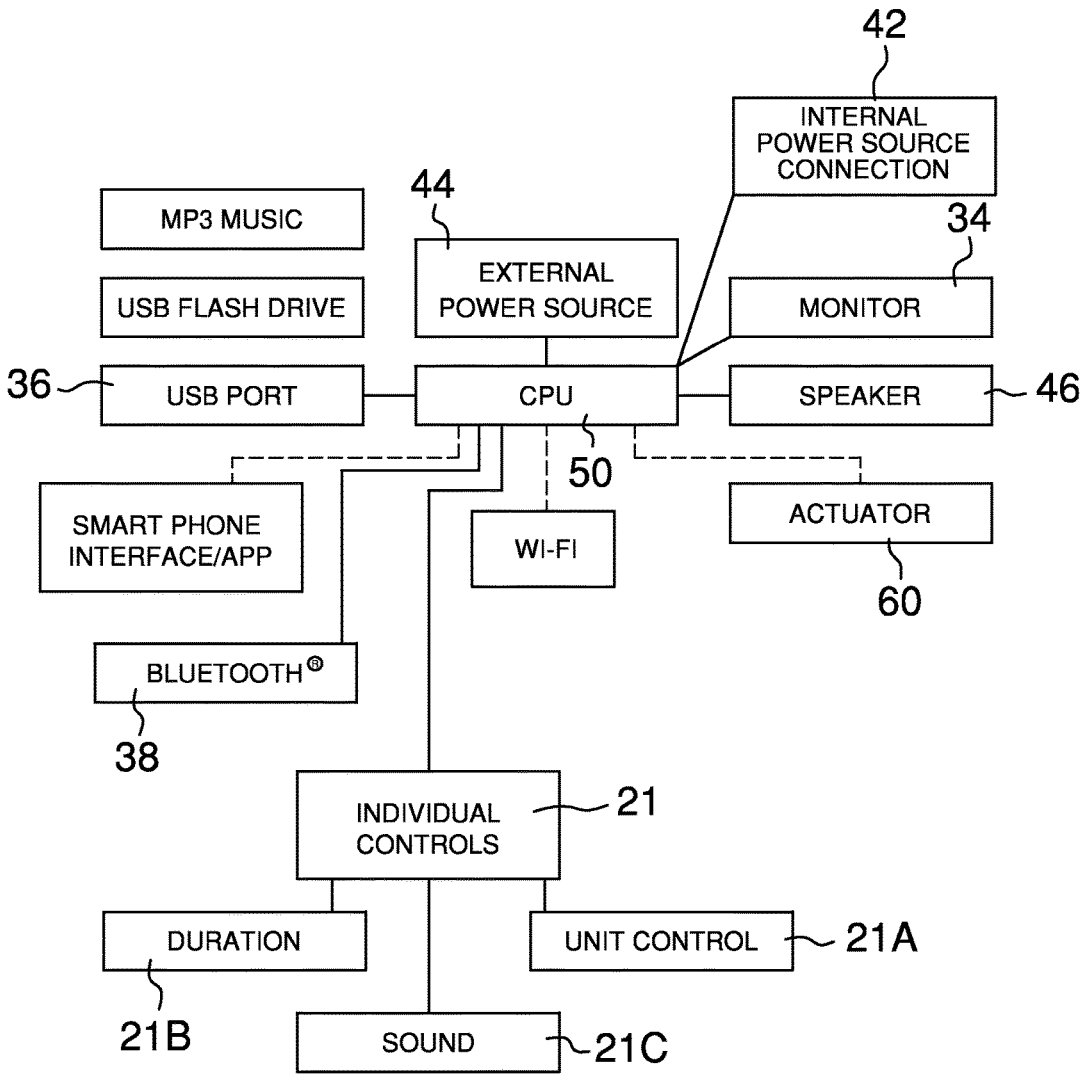
FIG. 5 is a block diagram.

With reference now to the drawings, and in particular FIGS. 1 through 5 thereof, an example of the accessorized doorbell device employing the principles and concepts of the present accessorized doorbell device and generally designated by the reference number 10 will be described.

Referring to FIGS. 1 through 5, the accessorized doorbell device 10 has a device control 20 having a front side 22 and a back side 24 spaced apart from the front side 22. The control device 20 has at least one mount 26 disposed on the back side 24. A plurality of control buttons 32 is disposed in the front side. A monitor 34 is disposed in the front side. The monitor 34 provides visual feedback for a user of a plurality of control button 32 choices. The choices include but are not limited to a plurality of sources of inputs and outputs of the device 10. The device control 20 also internally has a USB port 36, a Bluetooth® capability 38, a WiFi® capability 40, an internal power source 42, and an external power source connection 44 in operational communication with the internal power source 42. The device control 20 further has a speaker 46. The speaker 46 provides audio feedback of the control button 32 choices. A central processing unit (CPU) 50 includes the Bluetooth® capability 38 and the WiFi® capability 40. The CPU further includes a plurality of individual controls 21 comprising a playback unit control 21A, a duration control 21B, and a sound control 21C. The CPU 50 is in operational communication with the control buttons 32, the monitor 34, the speaker 46, the USB port 36, the internal power source 42, and the external power source connection 44.

At least one wireless actuator 60 is in operational communication with the device control 20. At least one playback unit 62 is in wireless communication with the device control 20.

The control buttons 32 are configured to provide for the user to choose from a myriad of choices. A plurality of individual controls 21 is disposed within the CPU 50 and comprise playback unit control 21A, a duration control 21B, and a sound control 21C. The playback unit control 21A is configured to regulate the playback units 62 played. The duration control 21B is configured to regulate a duration of the playback units 62 played. The sound control 21C is configured to regulate a sound emitted from the playback unit 62. For example, only a pair of playback units 62 might be for use if the actuator 60 is enabled for a continuous 5 seconds. Conversely, the actuator, such as a doorbell, typically sees a one-half second to one second enablement. The speaker 46 only could be set to play upon such a signal. Also, every playback unit 62 could be set to play upon the signal. A known visitor may be instructed to employ the signal for an identification by those within a given abode. The sound control 21C may be set for the emission of a particular sound from the chosen playback units 62. The duration control 21B not only determines a duration needed by the actuator 60 to determine the sound emitted by the playback units 62.

What is claimed is:

1. An accessorized doorbell device, comprising:

a device control having a front side and a back side spaced apart from the front side, the control device having;

at least one mount disposed on the back side;

a plurality of control buttons disposed in the front side;

a monitor disposed in the front side, wherein the monitor is configured to provide a visual feedback of control button choices;

a USB port;

a Bluetooth® capability;

a WiFi® capability;

an internal power source;

an external power source connection in operational communication with the internal power source;

a speaker disposed on the front side wherein the speaker is configured to provide an audio feedback of the control button choices;

a central processing unit having the Bluetooth® capability and the WiFi® capability, the central processing unit in operational communication with the plurality of control buttons, the monitor, the speaker, the USB port, the internal power source, and the external power source connection;

a plurality of individual controls disposed within the central processing unit, the plurality of individual controls comprising a duration control, a sound control, and a playback unit control;

wherein the plurality of control buttons are configured to regulate the plurality of individual controls;

wherein the unit control is configured to regulate a playback unit played;

wherein the duration control is configured to regulate a duration of the playback unit played;

wherein the sound control is configured to regulate a sound emitted from the playback unit;

a wireless actuator in operational communication with the device control; and the playback unit in wireless communication with the device control.

2. The accessorized doorbell device of claim 1 wherein the playback unit further comprises a plurality of playback units in wireless communication with the device control.

3. The accessorized doorbell device of claim 2 wherein the wireless actuator further comprises a plurality of wireless actuators.

4. The accessorized doorbell device of claim 1 wherein the wireless actuator further comprises a plurality of wireless actuators.

* * * * *